US006213405B1

(12) United States Patent
Spiegel

(10) Patent No.: US 6,213,405 B1
(45) Date of Patent: Apr. 10, 2001

(54) SUPPLEMENTAL HEAT SOURCE

(76) Inventor: Bill Spiegel, One W. Pine St., Arcadia, FL (US) 34266

( * ) Notice: Subject to any disclaimer, the term of this patent is extended or adjusted under 35 U.S.C. 154(b) by 0 days.

(21) Appl. No.: 09/595,966

(22) Filed: Jun. 19, 2000

(51) Int. Cl.[7] ..... G08D 23/00
(52) U.S. Cl. ..... 237/2 B; 62/151; 62/161
(58) Field of Search ..... 237/2 B; 62/151, 62/161, 238.7

(56) References Cited

U.S. PATENT DOCUMENTS 3,926,008 * 12/1975 Webber ..... 62/200
4,279,128 * 7/1981 Leniger ..... 62/238.6
4,907,418 * 3/1990 DeFazio ..... 62/238.6
5,184,472 * 2/1993 Guilbault et al. ..... 62/160
5,560,216 * 10/1996 Holmes ..... 62/161
5,802,864 * 9/1998 Yarbrough et al. ..... 62/238.6

* cited by examiner

*Primary Examiner*—Harold Joyce
*Assistant Examiner*—Derek S. Boles
(74) *Attorney, Agent, or Firm*—Frank A. Lukask

(57) ABSTRACT

A supplemental heat source in a pool heating system consisting of a heat reserve element, a contactor, a switch/relay, a light and an accessory switch. The contactor engages the supplemental heat reserve element when the ambient temperature drops to the middle forty degree range. The supplemental heat source replaces the compressor as the heat source and allows the compressor to defrost.

1 Claim, 1 Drawing Sheet

SUPPLEMENTAL HEAT SOURCE

BACKGROUND OF THE INVENTION

1. Field of the Invention

The present invention relates generally to swimming pool heat pumps and more specifically to utilizing a heating element as a component of a swimming pool heat pump.

2. Discussion of the prior art

The prior art swimming pool heat pumps work as follows. The fan draws outside air over the surface of the evaporator, and liquid refrigerant, within the evaporator, expands, thereby forming a gas which draws heat from the outside air. The warm gas then passes through a compressor and the heat increases as the gas is compressed into a liquid as it passes through the condenser, known as the heat exchanger. The cooler swimming pool water is circulated around the condensing coil, absorbing the heat being created in the condenser by the compressing of the gas. The liquid refrigerant then passes through an expansion valve and starts the cycle over again. When there is adequate heat in the ambient air, the process can go on indefinitely, thus heating the pool water.

The problem starts to occur when the ambient air starts to get too cold (usually at a point in the mid 40's). The temperature on the surface of the evaporator drops below freezing, and ice (from the humidity in the air) starts to form on the evaporator. The ice prevents air flow across the evaporator, thus preventing the gas from picking up any heat. The heat pump then shuts down because the heat pump can no longer convert the refrigerant from liquid to gas. The problem is a swimming pool heat pump's inability to continue to supply heat to a swimming pool when the ambient air temperature drops into the mid 40's, the time when a pool requires the most heat.

U.S. Pat. No. 2,847,190 to Slattery discloses a heat pump air conditioner for a house having an auxiliary heater which turns on during a frost condition. The compressor is shut down until the defrost condition is alleviated, at which point is automatically set back into operation.

U.S. Pat. No. 3,366,166 to Gerteis discloses a heating system which heats both air and water using a heat pump.

U.S. Pat. No. 4,543,468 to Shaffer discloses a hot water heater using a heat pump and heating elements. In response to a demand for heat water, indicated by a thermostat, the heating cycle begins. In normal operation, the heating elements are bypassed and the heat pump operates. If an abnormal condition is sensed, such as frost on the evaporator, the heat pump is turned off and the heating element is turned on for the remainder of the cycle.

U.S. Pat. No. 4,550,770 to Nussdorfer et al discloses an air conditioner/heater with low and high wattage heating elements integral to the air conditioning unit. In very cold weather, the compressor is not used, and heat is supplied by the low and high wattage heating elements. In other temperature conditions, the compressor is used and the heating elements are turned off.

U.S. Pat. No. 4,517,807 to Harnish discloses a hot water heater, using both a heat pump and heating elements. In an operating cycle, the heat pump is turned on to heat the water until the water reaches a preset temperature. During the cycle, a thermostat detects whether ice is formed on the heat pump evaporator. In response to frost detection, the heat pump is turned off and the supplemental heat supply consisting of two heating elements within the water tank, is turned on. The heating elements stay on until the water reaches the predetermined temperature. The heat pump remains shut down until the next cycle, in order to extend the operating life of the compressor.

By U.S. Pat. No. 5,205,133 to Lackstrom discloses the need for a supplemental heating system increases when a hot tub is used, since hot tubs are used year-round. The Lackstrom system itself does not use a resistance heater at low temperatures, but uses a power circuit consisting of a heat exchanger and working fluid. A heat pump is used at higher temperatures.

SUMMARY OF THE INVENTION

The broad purpose of the invention is to utilize a heating element as a component of a swimming pool heat pump instead of the current practice of utilizing an independent electric resistance heater as a secondary heat source. The proposed heat pump will have only one set of controls and one connection to the source of power. Currently when a heat pump is supplemented by another heat source, the supplemental heat source is a separate and independent heater, often even manufactured by a second manufacturer, not an additional internal component of the heat pump. The heating element of the instant invention will be sized to draw the same amperage as the heat pump's compressor, allowing it to operate without any additional wiring or any additional source of power. While the supplemental heating element of the invention is replacing the compressor as the heat source, and allowing it to defrost, it will utilize the same controls, safeties and other components of the heat pump. Currently, secondary heat sources have their own power source and controls, and not balanced to match the amperage draw of the heat pump's compressor.

BRIEF DESCRIPTION OF THE DRAWING

The FIGURE is a representative wiring diagram of a first embodiment in accordance with the invention.

DESCRIPTION OF A PREFERRED EMBODIMENT

Figure 1:
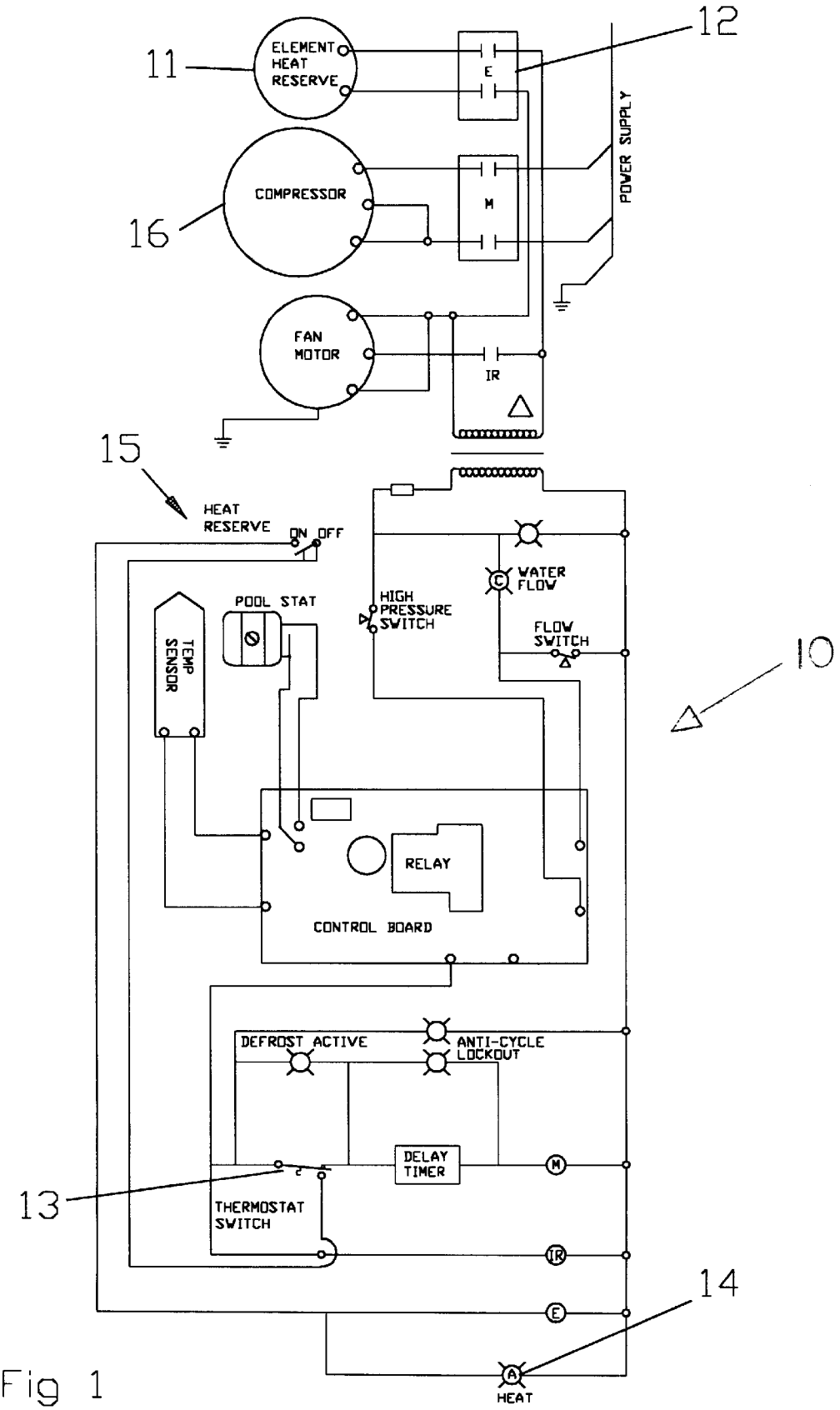

The instant invention corrects the defects in the prior art swimming pool heat pumps by combining the following two existing technologies into one system: (1) Liquid refrigerant technology, as found in heat pumps and air conditioners; (2) Resistance heating element technology, as found in electric water heaters, clothes dryers, irons, waffle irons, toasters, space heaters, etc.

The supplemental heat source of the invention is designated generally by the numeral 10. The principle components of the invention consist of the heat reserve element 11, a contactor 12, the switch/relay 13, the light 14 and the accessory switch 15. The heating element 11 is sized to match the amperage draw that will be available when the compressor 16 is not running. The The contactor 12 engages the supplemental heating element 11 when the circuitry calls for the element 11 to create heat. The switch/relay 13 turns off the compressor 16 and turns on the heating element 11. The light 14 indicates when the heating element is working. The heat reserve accessory switch 15 allows the operator to decide whether he wants to utilize the heating element 11 feature of the invention.

The instant invention permits the swimming pool heat pump compressor 16 to continue to provide heat to the swimming pool water by circulating the swimming pool water through the heat pump, as previously described, and over a heat exchanger coil. When ambient conditions caused the compressor 16 to shut down, the energy that was being consumed by the compressor 16 (electric power) would be switched over to the heating element 11 of the invention. The heating coil immersed in the circulating pool water would continue to heat the swimming pool. The fan of the new heater would continue to run, facilitating the defrosting of the evaporator. As soon as the evaporator is defrosted, and able to pick up heat again, the energy would be switched from the heating element 11 back to the heater's compressor. If icing occurs again, the heater switch 13 would switch back to the supplemental heating element 11.

Swimming pool heat pumps have been around for years and resistance heating has been around for even longer, but no one has yet combined these two technologies into one machine. The instant invention combines these two proven heating techniques into one device, thus creating a better pool heater. The uniqueness of the instant invention is the utilization of a heating element 11 as a component of the heat pump, instead of the prior art system of utilizing a separate electric resistance heater as a secondary heat source. Furthermore, the balancing of the amperage draw of the heating element 11 and the compressor 16 to allow the additional feature to be added to the machine without additional wiring and expense.

The FIGURE is a wiring diagram of a typical swimming pool heat pump plus the wiring and components that would be required to implement the instant invention. The described configuration is an example of one way to wire the invention and any variation that could produce the same result would be included. The invention is the combination of the two technologies into one integral unit as stated above.

What is claimed is:

1. A supplemental heat source in a pool heating system for heating a swimming pool with a heat pump compressor when the ambient air temperature drops below fifty degrees, the heat source consisting of:

a heat reserve element, a contactor, a switch/relay, a light, and an accessory switch, said heat reserve element being sized to match the amperage draw when the compressor is not running, said contactor engaging said heat reserve element when additional heat is required, said switch/relay turning off the compressor and turning on the said heat reserve element, a light indicating when said heat reserve element is turned on, and a manually operable heat reserve accessory switch for activating said heat reserve element when the ambient temperature drops to the point when additional heat is required for operation of the heat pump.

* * * * *